US010786105B2

(12) United States Patent
Scanlon

(10) Patent No.: US 10,786,105 B2
(45) Date of Patent: Sep. 29, 2020

(54) TELESCOPING CURTAIN ROD FINIAL ASSEMBLIES

(71) Applicant: DECOLIN Inc., Montréal, Québec (CA)

(72) Inventor: Ben Scanlon, Philadelphia, PA (US)

(73) Assignee: Decolin Inc. (CA)

( * ) Notice: Subject to any disclaimer, the term of this patent is extended or adjusted under 35 U.S.C. 154(b) by 20 days.

(21) Appl. No.: 16/135,046

(22) Filed: Sep. 19, 2018

(65) Prior Publication Data

US 2019/0082875 A1 Mar. 21, 2019

Related U.S. Application Data

(60) Provisional application No. 62/561,257, filed on Sep. 21, 2017.

(51) Int. Cl.

| | |
|---|---|
| ***A47H 1/102*** | (2006.01) |
| ***A47K 3/38*** | (2006.01) |
| ***A47H 1/022*** | (2006.01) |
| ***A47H 1/142*** | (2006.01) |
| *A47H 1/02* | (2006.01) |

(52) U.S. Cl.

CPC ..... *A47H 1/102* (2013.01); *A47H 1/022* (2013.01); *A47H 1/142* (2013.01); *A47K 3/38* (2013.01); *A47H 2001/0215* (2013.01)

(58) Field of Classification Search

CPC ..... A47H 1/102; A47H 1/022; A47H 1/142; A47H 2001/0215; A47K 3/38

USPC ..... 211/123, 105.1, 105.4, 105.5, 105.6

See application file for complete search history.

(56) References Cited

U.S. PATENT DOCUMENTS

| | | | | |
|---|---|---|---|---|
| 2,199,851 | A | 5/1940 | Culver | |
| 2,974,806 | A | 3/1961 | Seewack | |
| 3,040,902 | A * | 6/1962 | Dunn | A47B 61/003 211/105.4 |
| 6,824,000 | B2 | 11/2004 | Samelson | |
| 6,913,156 | B1 | 7/2005 | Wolff | |
| 7,857,151 | B2 | 12/2010 | Barrese | |
| 7,877,824 | B2 * | 2/2011 | Grant | A47K 3/38 4/576.1 |
| 8,505,749 | B2 * | 8/2013 | Trettin | A47K 3/38 211/105.2 |

(Continued)

OTHER PUBLICATIONS

Notification of Transmittal of the International Search Report and the Written Opinion of the International Searching Authority for International Application No. PCT/CA2018/051168, 11 pages.

*Primary Examiner* — Patrick D Hawn

(74) *Attorney, Agent, or Firm* — Alan G. Towner; Leech Tishman Fuscaldo & Lampl

(57) ABSTRACT

Finial end cap assemblies for telescoping curtain rods are disclosed. The finial assemblies include an outer finial cover and an inner finial base threadably mounted into each end of a curtain rod. A rotatable end pad is mounted on each finial base. The rods may include telescoping sections that are axially extendable from each other and lockable by a twisting motion. During installation on a support structure such as a window frame or shower stall, the finial cover, finial base and end of the curtain rod are fixed together by threaded engagement of the finial base with a threaded insert inside the end of the curtain rod, while the end pad is freely rotatable in order to maintain stationary contact with the support structure when the rod sections are twisted.

16 Claims, 10 Drawing Sheets

(56) References Cited

U.S. PATENT DOCUMENTS

| | | | | |
|---|---|---|---|---|
| 8,827,587 | B2 | 9/2014 | Didehvar | |
| 8,869,999 | B2 | 10/2014 | Lindo et al. | |
| 8,960,456 | B2 | 2/2015 | Didehvar | |
| 9,021,627 | B2 * | 5/2015 | Parker | A47K 3/38 211/105.4 |
| 10,458,452 | B2 * | 10/2019 | Beyda | A47H 1/02 |
| 2004/0040920 | A1 * | 3/2004 | Samelson | A47H 1/08 211/105.3 |
| 2008/0163418 | A1 * | 7/2008 | Barrese | A47K 3/38 4/610 |
| 2009/0223917 | A1 * | 9/2009 | Grant | A47K 3/38 211/105.4 |
| 2011/0031198 | A1 * | 2/2011 | Trettin | A47H 1/022 211/123 |
| 2012/0005823 | A1 * | 1/2012 | Baines | A47K 3/38 4/610 |
| 2012/0241399 | A1 * | 9/2012 | Trettin | A47H 1/022 211/123 |
| 2012/0284914 | A1 | 11/2012 | Bauer | |
| 2013/0112639 | A1 * | 5/2013 | Baines | A47H 1/022 211/123 |
| 2013/0200024 | A1 * | 8/2013 | Lindo | A47H 1/022 211/105.3 |
| 2013/0334156 | A1 * | 12/2013 | Baines | A47B 55/00 211/134 |
| 2014/0166603 | A1 | 6/2014 | Baines | |
| 2014/0259368 | A1 * | 9/2014 | Parker | A47K 3/38 4/610 |
| 2014/0360959 | A1 * | 12/2014 | Didehvar | A47H 1/022 211/105.2 |
| 2014/0360960 | A1 * | 12/2014 | Didehvar | A47K 3/38 211/123 |
| 2016/0206126 | A1 * | 7/2016 | Ford | A47H 1/022 |

* cited by examiner

TELESCOPING CURTAIN ROD FINIAL ASSEMBLIES

CROSS-REFERENCE TO RELATED APPLICATION

This application claims priority from U.S. Provisional Application No. 62/561,257 filed Sep. 21, 2017, which is incorporated herein by reference.

FIELD OF THE INVENTION

The present invention relates to curtain rod finials, and more particularly relates to finial assemblies for telescoping curtain rods.

BACKGROUND INFORMATION

Telescoping curtain rods may be used for window curtains and shower curtains. In some types of telescoping rods, a relatively small diameter rod section extends axially from a larger diameter rod section. During installation, the rod sections are extended to a desired length to press against a support structure such as a window opening or a shower stall, and are secured in place by twisting the rod sections in relation to each other. Examples of lockable telescoping curtain rods are described in U.S. Pat. Nos. 8,960,456 and 8,827,587, and U.S. Patent Application Publication No. 2014/0166603, which are incorporated herein by reference.

SUMMARY OF THE INVENTION

The present invention provides finial end cap assemblies for telescoping curtain rods. The finial assemblies include an outer finial cover and an inner finial base threadably mounted into each end of a curtain rod. A rotatable end pad is mounted on each finial base. The rods may include telescoping sections that are axially extendable from each other and lockable by a twisting motion. During installation on a support structure such as a window frame or shower stall, the finial cover, finial base and end of the curtain rod are fixed together by threaded engagement of a threaded stud of the finial base with a threaded insert inside the end of the curtain rod, while the end pad is freely rotatable in order to maintain stationary contact with the support structure when the rod sections are twisted.

An aspect of the present invention is to provide a curtain rod and finial assembly comprising a telescoping curtain rod having a first end and a second end, and a first finial assembly mounted on the first end of the curtain rod. The finial assembly comprises a finial base including a body, an annular base rim, a central through hole radially inside the annular base rim, a shoulder at an end of the body opposite from the annular base rim, and a threaded stud extending from the shoulder. A finial cover surrounds the finial base and includes a recess receiving the first end of the curtain rod. A rotatable end pad is rotatably mounted adjacent the annular base rim and includes a projection extending through the through hole of the finial base structured and arranged to retain the rotatable end pad on the finial base. The threaded stud of the finial base is threadingly secured to the first end of the curtain rod, and a bottom wall of the recess of the finial cover is located between the shoulder of the finial base and the first end of the curtain rod.

Another aspect of the present invention is to provide a finial assembly for mounting on an end of a curtain rod. The finial assembly comprises a finial base and includes a body, an annular base rim, a central through hole radially inside the annular base rim, a shoulder at an end of the body opposite from the annular base rim, and a threaded stud extending from the shoulder. A finial cover surrounds the finial base and includes a recess receiving the first end of the curtain rod. A rotatable end pad rotatably mounted adjacent the annular base rim and including a projection extending through the through hole of the finial base structured and arranged to retain the rotatable end pad on the finial base.

These and other aspects of the present invention will be more apparent from the following description.

DETAILED DESCRIPTION

Figure 1:
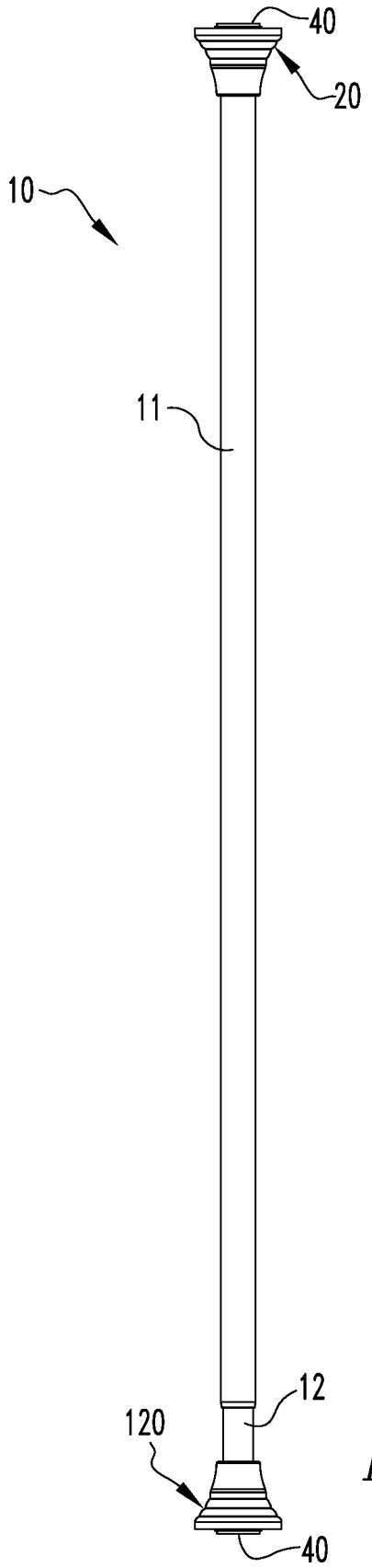
FIG. 1 is a side view of a telescoping curtain rod including finial assemblies in accordance with an embodiment of the present invention.

FIG. 1 illustrates a telescoping curtain rod 10 including an outer rod section 11 having a relatively large diameter and an inner rod section 12 having a relatively small diameter. A finial assembly 20 is attached to the end of the outer rod section 11, and another finial assembly 120 is attached to the end of the inner rod section 12. A rotatable end pad 40 is provided at the end of each of the finial assemblies 20 and 120, as more fully described below. Any suitable mechanism, such as twist and lock systems known to those skilled in the art, may be used to lock the telescoping outer and inner rod sections 11 and 12 into the desired position, for example, as described in U.S. Pat. Nos. 8,960,456 and 8,827,587, and U.S. Patent Application Publication No. 2014/0166603.

Figure 2:
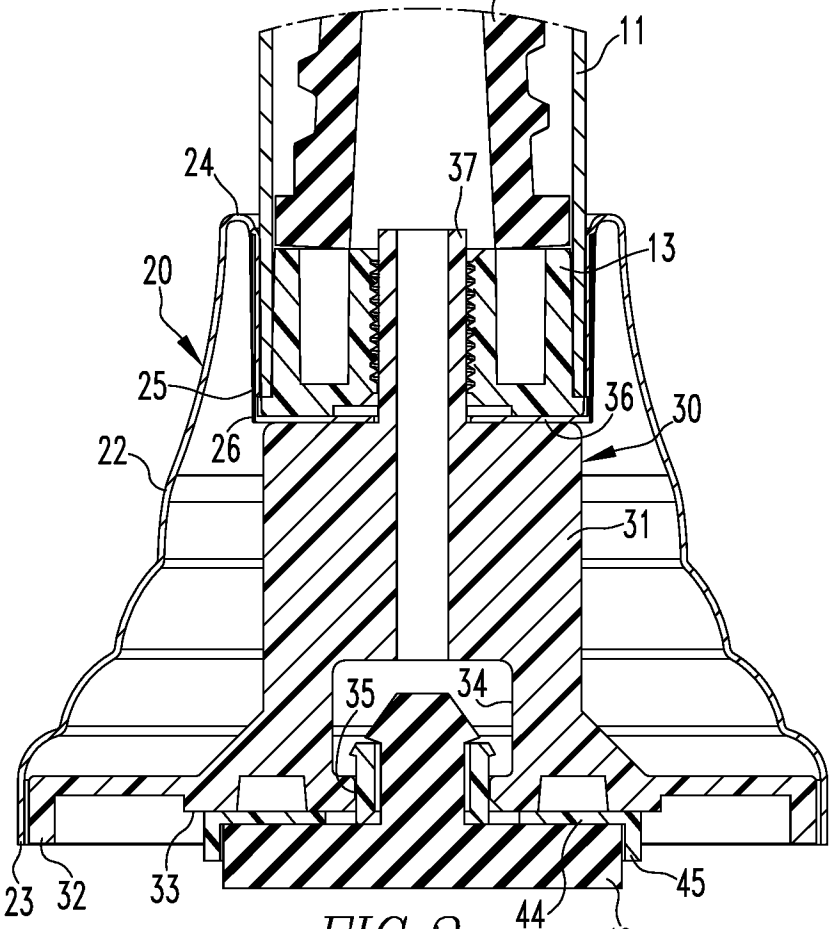
FIG. 2 is a side sectional view of a finial assembly attached to an end of a telescoping curtain rod in accordance with an embodiment of the present invention.
Figure 4:
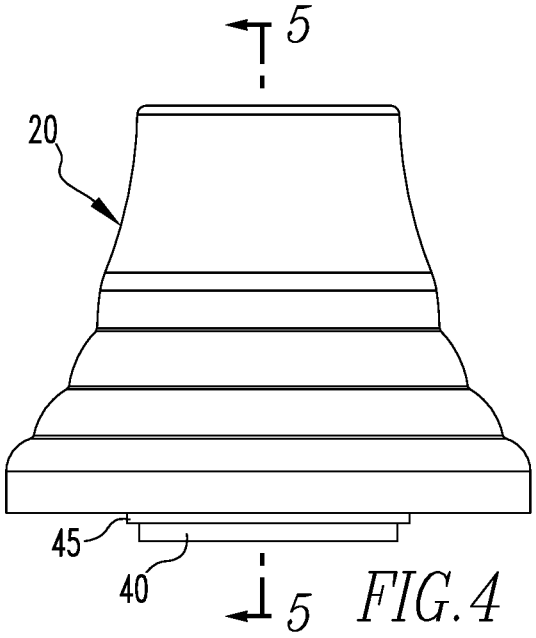
FIG. 4 is a side view of a finial assembly in accordance with an embodiment of the present invention.
Figure 5:
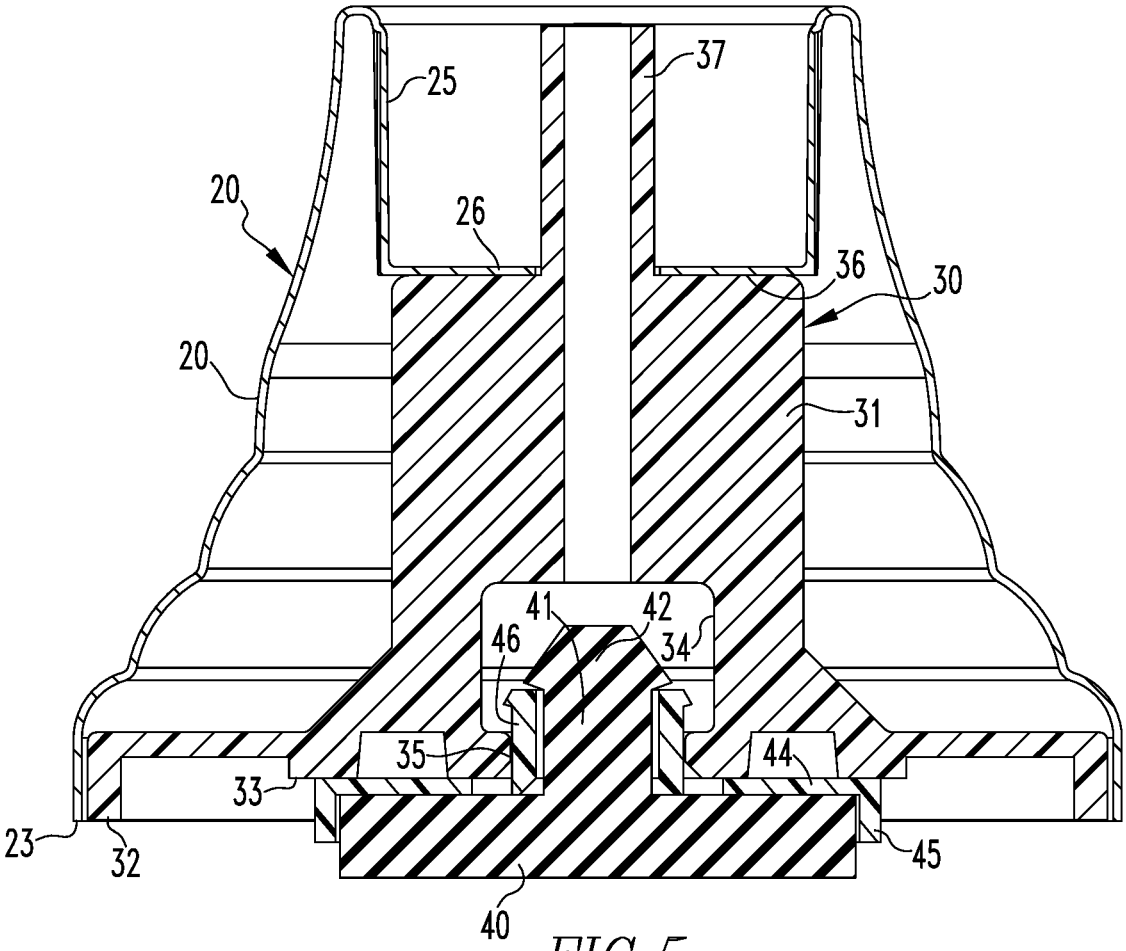
FIG. 5 is a sectional view taken through section 5-5 of FIG. 4.
Figure 6:
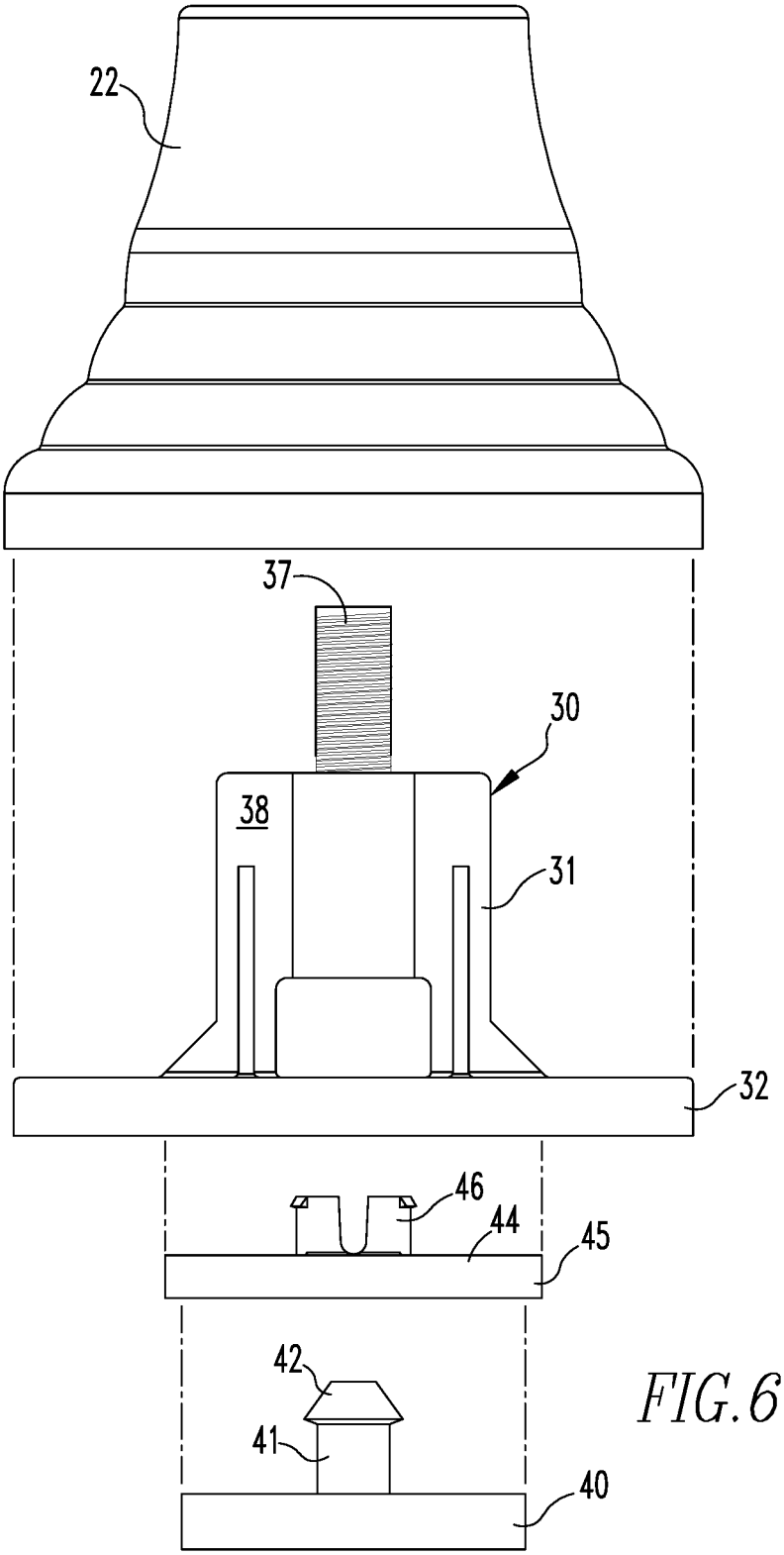
FIG. 6 is an exploded side view illustrating components of a finial assembly in accordance with an embodiment of the present invention.
Figure 7:
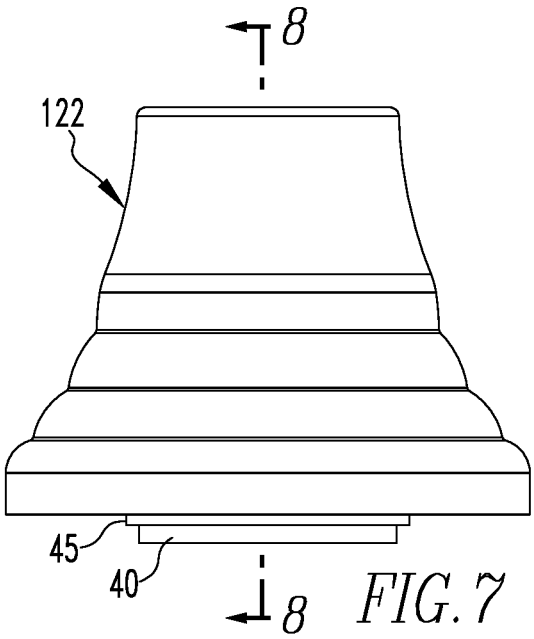
FIG. 7 is a side view of a finial assembly in accordance with an embodiment of the present invention.
Figure 8:
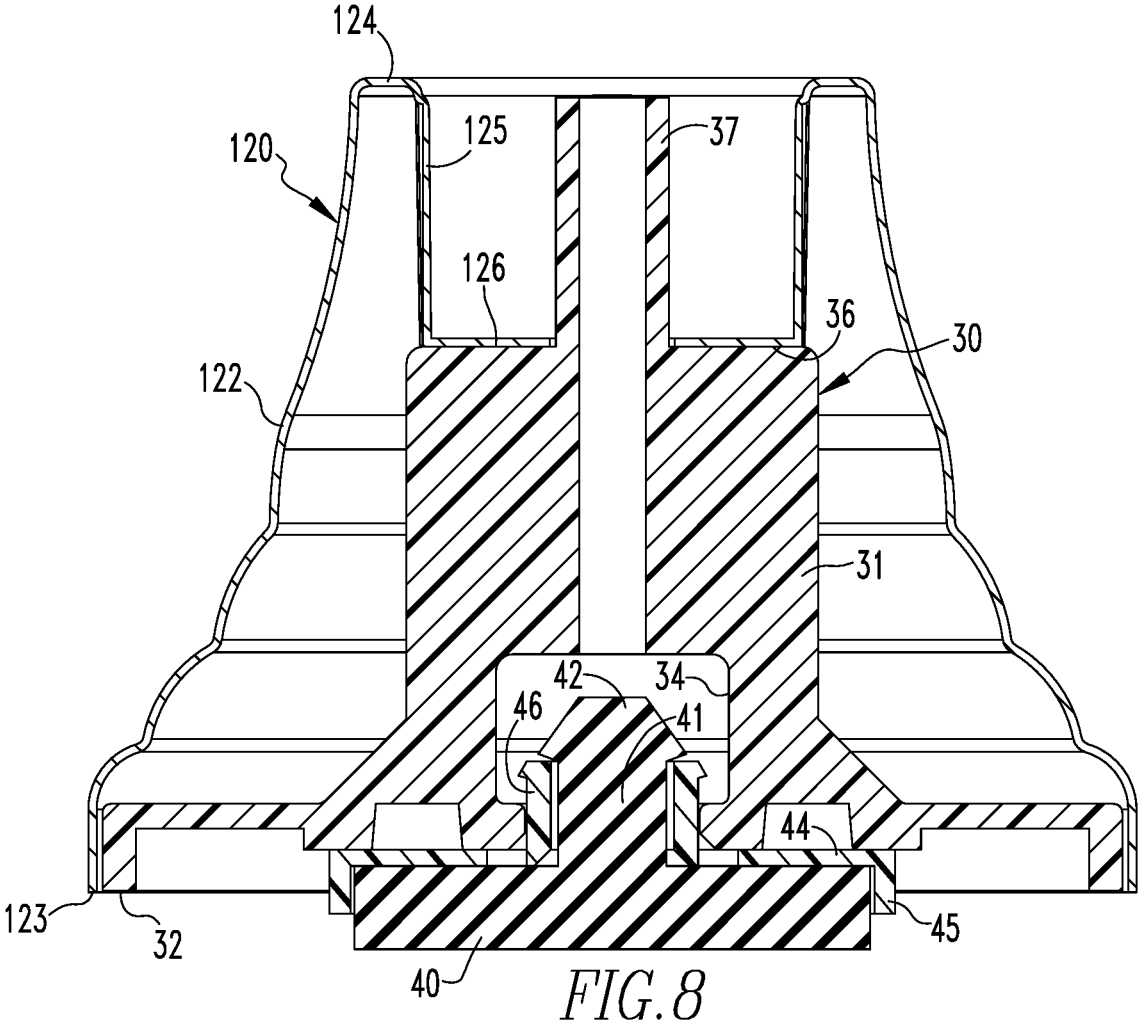
FIG. 8 is a sectional view taken through section 8-8 of FIG. 7.
Figure 9:
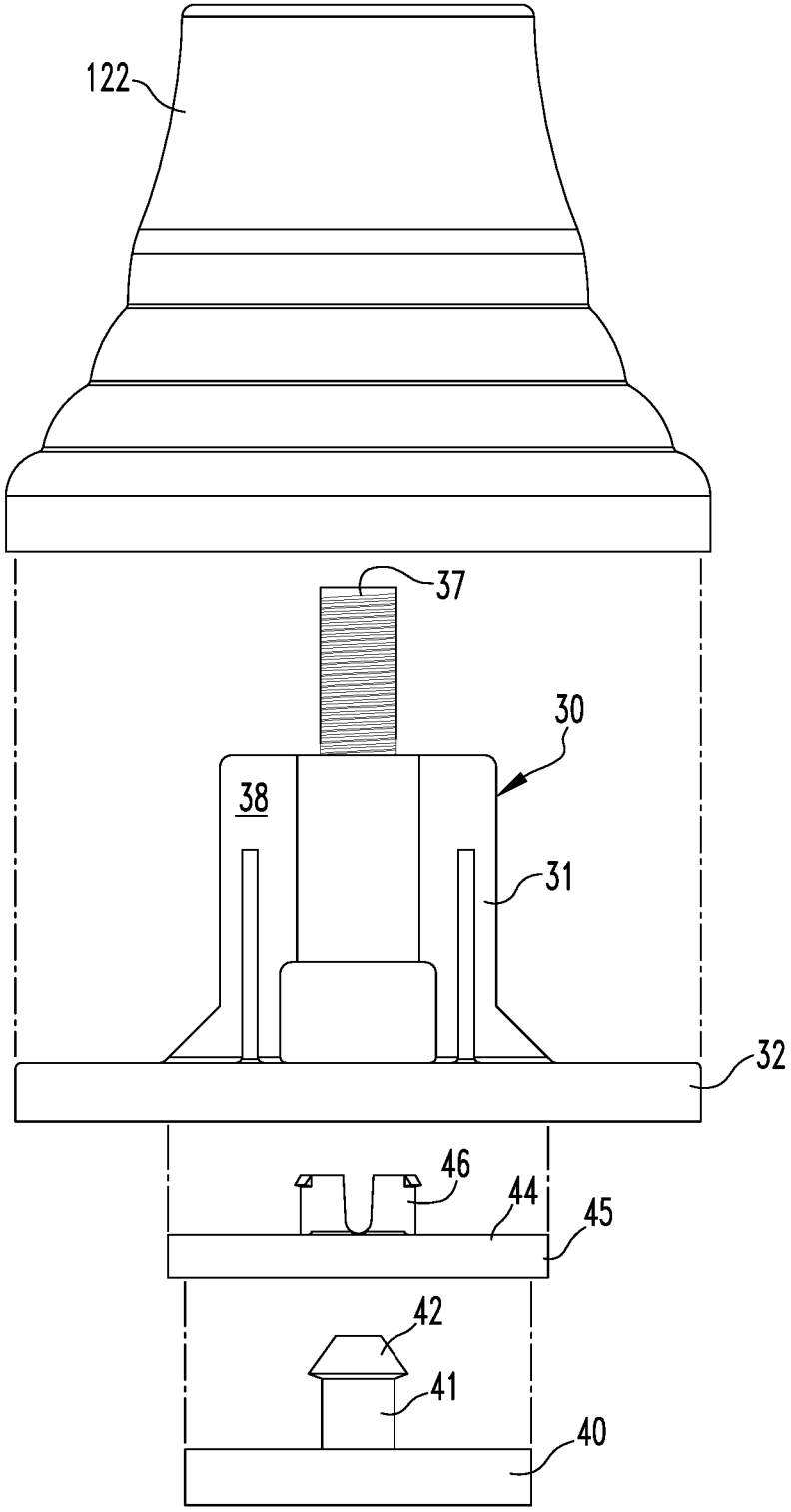
FIG. 9 is an exploded side view illustrating components of a finial assembly in accordance with an embodiment of the present invention.

As shown in FIG. 2, in accordance with an embodiment of the present invention, the outer rod section 11 may include a tension mechanism 19 forming part of a twist and lock assembly for releasably locking the outer and inner rod sections 11 and 12 together in a desired axial position. The tension mechanism 19 may be part of a conventional twist and lock assembly as described in U.S. Pat. Nos. 8,827,587 and 8,960,456.

As shown in FIG. 2, the end of the outer rod section 11 is secured to the finial assembly 20. The finial assembly 20 includes an outer finial cover 22 with an annular open end 23 and a rod-receiving opening 24 at an opposite end. The end of the outer rod section 11 is received within a recess 25 in the rod receiving opening 24, and contacts a bottom wall 26 of the recess 25.

Figure 3:
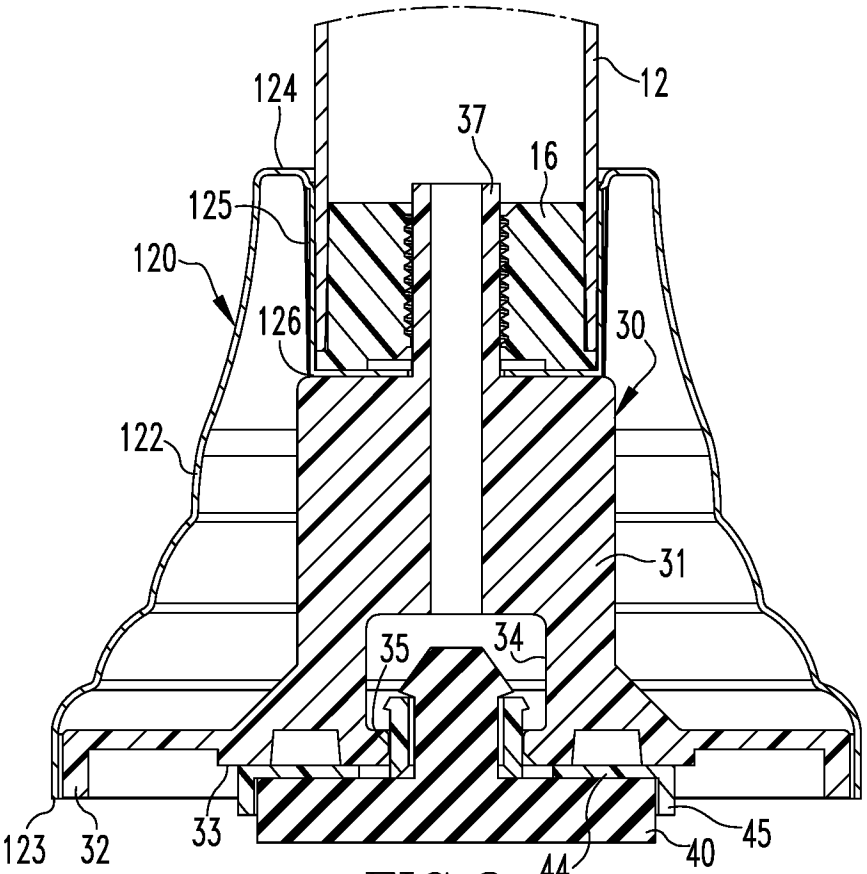
FIG. 3 is a side sectional view of another finial assembly attached to an end of a telescoping curtain rod in accordance with an embodiment of the present invention.

FIG. 3 illustrates the finial assembly 120 mounted at the end of the inner rod section 12. The finial assembly 120 includes an outer finial cover 122 with an annular open end 123 and a rod-receiving opening 124 at an opposite end. The end of the inner rod section 12 is received within a recess 125 in the rod receiving opening 124, and contacts a bottom wall 126 of the recess 125.

Figure 10A:
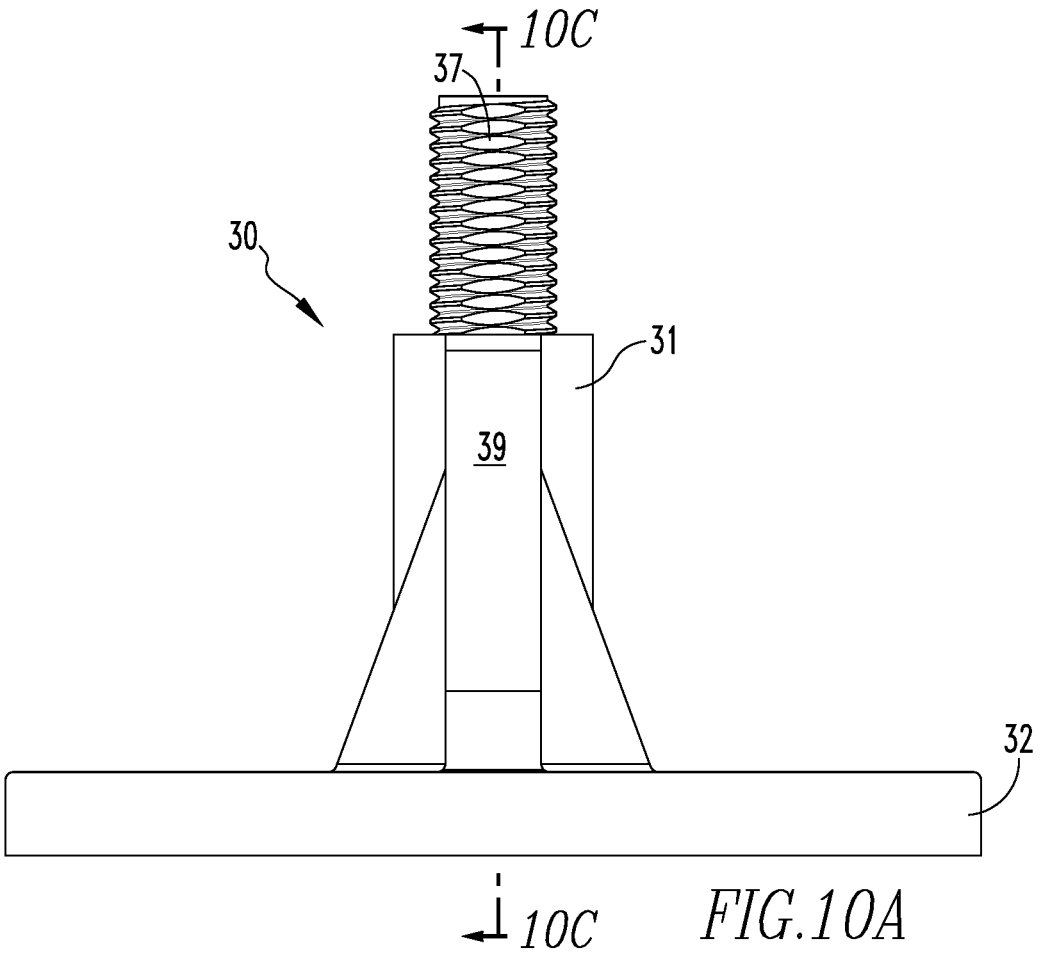
FIG. 10A is a side view.
Figure 10B:
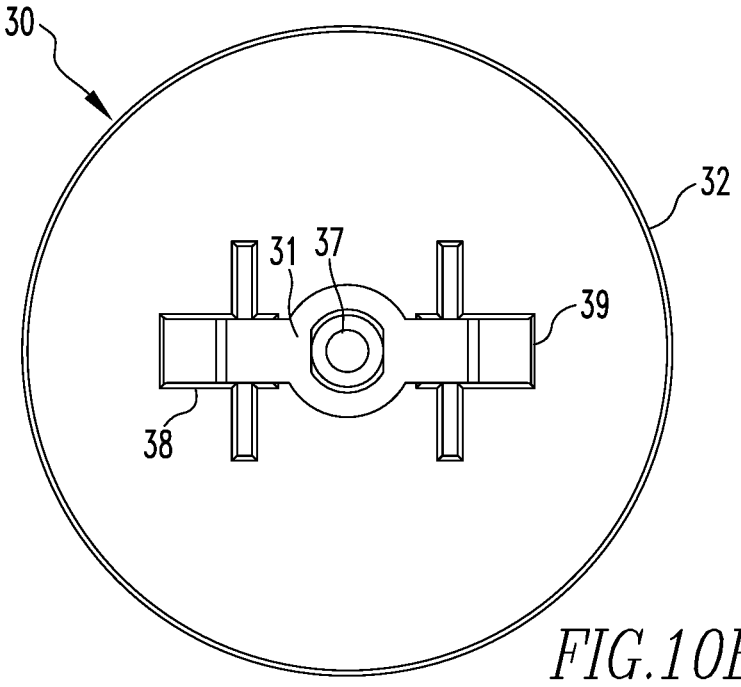
FIG. 10B is a top view.
Figure 10C:
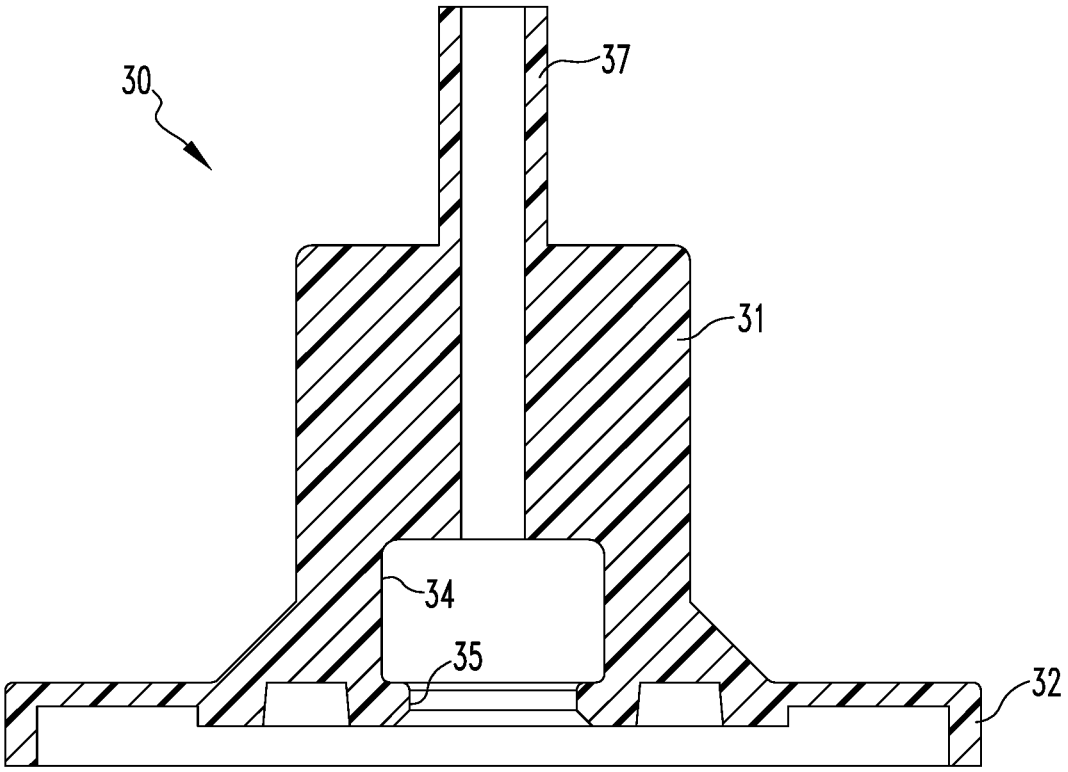
FIG. 10C is a side sectional view.
Figure 10D:
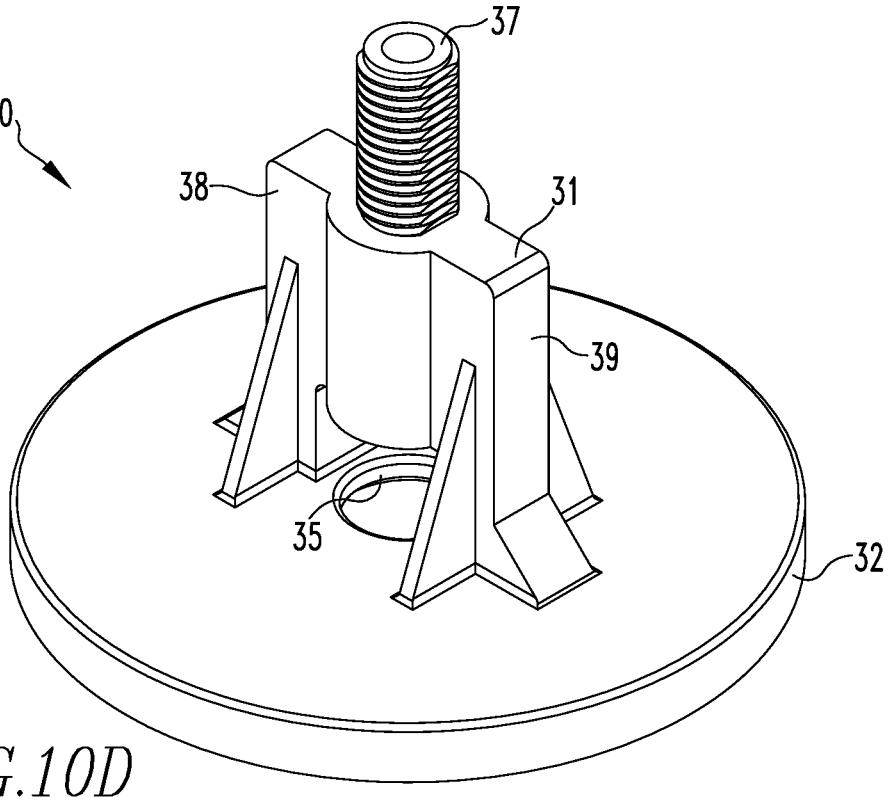
FIG. 10D is an isometric view of a finial base of a finial assembly in accordance with an embodiment of the present invention.

As shown in FIGS. 2 and 3, each of the finial assemblies 20 and 120 includes a finial base 30. Each finial base 30 includes a body 31 and an annular base rim 32. The finial base 30 has an abutment surface 33 radially inside the annular base rim 32. As shown most clearly in FIGS. 2, 3, 5, 8 and 10A-D, the finial base 30 includes a cut-out portion 34 and a central through hole 35. The finial base 30 also includes a shoulder 36 with a threaded stud 37 extending therefrom. As shown most clearly, in FIGS. 6, 9 and 10A-D, the body 31 of the finial base 30 includes relatively broad side surfaces 38 and relatively narrow side surfaces 39. The body 31 therefore has a generally rectangular cross-sectional shape, as shown in FIGS. 10B and 10D. The rectangular cross-section of the finial body 31 may have a width that is at least 2 or 3 times greater than a thickness of the finial body 31. For example, the ratio of the width to thickness may be from 2:1 to 10:1, or from 3:1 to 8:1, or from 4:1 to 6:1.

As shown in FIGS. 2 and 3, the body 31 of the finial base 30 is relatively wide in the views shown in order to provide increased support for the rod sections 11 and 12. The shoulder 36 of the finial body extends substantially across the entire diameter of each rod section 11 and 12, and is able to carry the axial load applied by the rod sections 11 and 12 when they are telescopingly extended from each other. In the absence of the relatively wide shoulder 36, the bottom walls 26 and 126 of finial covers 20 and 120 may be unsupported at their outer radial edges, which could result in deformation of the relatively thin finial covers 20 and 120.

The components of the finial assemblies may be made of any suitable materials such as plastic, metal, rubber and the like. For example, the finial covers 22 and 122 may be made of metal such as aluminum or stainless steel, the finial base 30 may be made of rigid plastic, and the threaded inserts 13 and 16 may be made of rigid plastic.

As shown in FIGS. 2-9, a rotatable end pad 40 made of a resilient material such as natural or synthetic rubber is rotatably mounted on the finial base 30. The rotatable end pad 40 is generally disk-shaped with an axial projection 41 and a head 42 extending from a surface thereof. The rotatable end pad 40 is mounted in a swivel bushing 44 having an annular rim 45 radially outside the outer diameter of the rotatable end pad 40, and including an annular retaining collar 46 extending therefrom. As shown most clearly in FIGS. 5, 6, 8 and 9, the projection 41 and head 42 and of the rotatable end pad 40 extend through the retaining collar 46 of the swivel bushing 44 to retain the rotatable end pad 40 on the swivel bushing 44 inside its annular rim 45. The swivel bushing 44 may be made of any suitable material such as plastic. Insertion of the projection 41 and head 42 of the end pad 40 through the retaining collar 46 of the swivel bushing 44 holds the end pad 40 securely on the swivel bushing 44. In addition, frictional engagement between the rubber end pad 40 and the plastic swivel bushing 44 helps prevent relative movement or rotation of the end pad 40 with respect to the swivel bushing 44.

The retaining collar 46 of the swivel bushing 44 is inserted through the through hole 35 of the finial base 30 and into the cut-out portion 34. A tolerance or gap may be provided between the outer surface of the retaining collar 46 and the through hole 35 such that rotation of the end pad 40 and swivel bushing 44 in relation to the finial base 30 is permitted. Furthermore, the finial base 30 may be made of a plastic material that provides minimal frictional resistance to rotation of the swivel bushing 44 in relation to the finial base 30. For example, frictional resistance is minimized between the plastic contact surface of the swivel bushing 44 and the abutment surface 33 of the plastic finial base 30.

Figure 11:
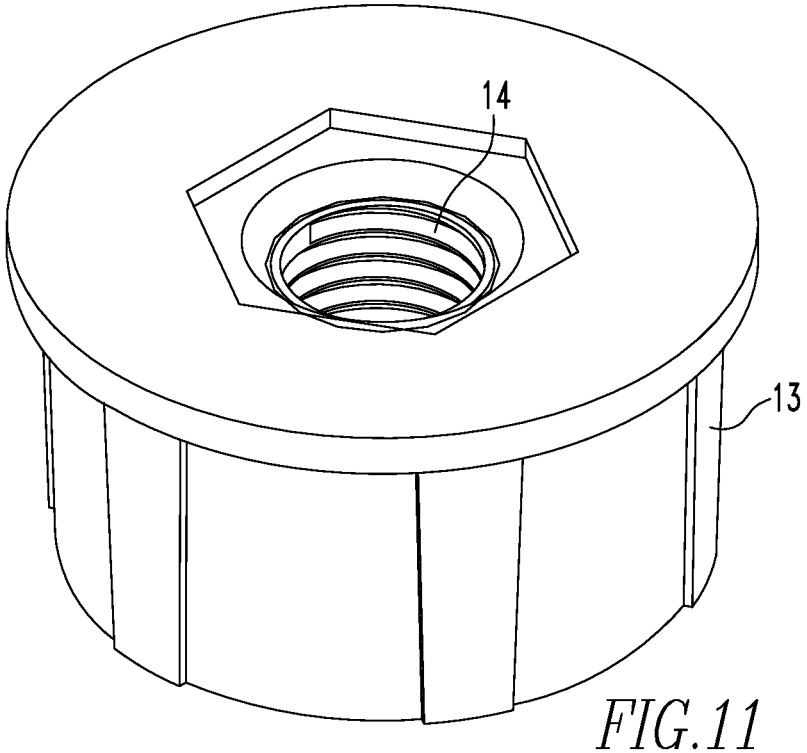
FIG. 11 is an isometric view of a threaded insert that may be installed in the end of a curtain rod section for attachment of a finial assembly in accordance with an embodiment of the present invention.
Figure 12:
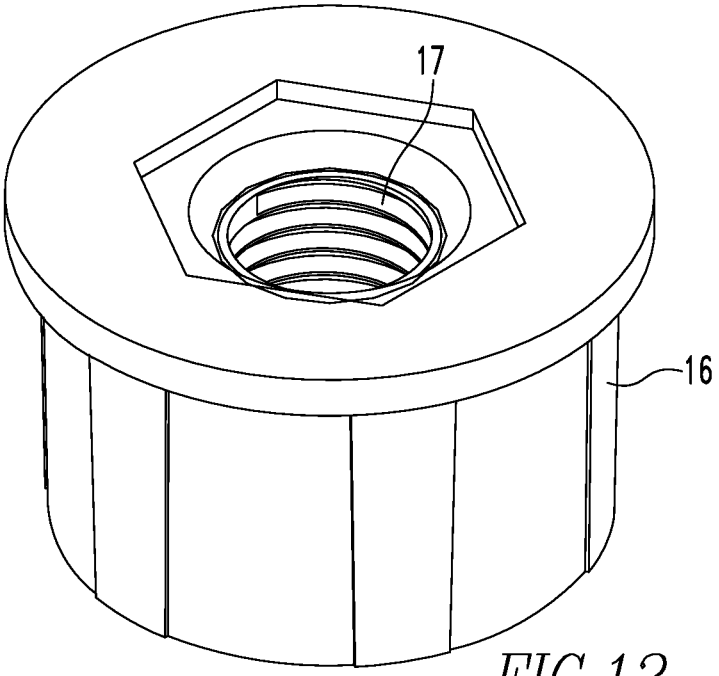
FIG. 12 is an isometric view of another threaded insert that may be installed in the end of a curtain rod section for attachment of a finial assembly in accordance with an embodiment of the present invention.

As described above, a threaded insert 13 is installed in the end of the outer rod section 11, and another threaded insert 16 is installed in the end of the inner rod section 12. The threaded inserts 13 and 16 are fixed upon installation and do not move in relation to their respective outer and inner rod sections 11 and 12. Details of the threaded inserts 13 and 16 are shown in FIGS. 11 and 12, respectively. The threaded insert 13 of the outer rod section 11 includes a central threaded hole 14. The threaded insert 16 of the inner rod section 12 includes a central threaded hole 17. In the embodiments shown, the threaded inserts 13 and 16 have raised external ribs running along their lengths that provide secure press fits when the inserts 13 and 16 are pressed into their respective outer and inner rod sections 11 and 12.

As shown in FIGS. 2 and 3, the threaded inserts 13 and 16 are secured to their respective finial bases 30 through engagement between the threaded stud 37 of the finial base 30 and the threaded holes 14 and 17 of the threaded inserts 13 and 16. In the tightened positions shown in FIGS. 2 and 3, the threaded inserts 13 and 16 press firmly against the bottom walls 26 and 126 of the recesses 25 and 125. Such engagement clamps the rod sections 11 and 12 to their respective finial covers 22 and 122 to provide relatively ridged structures in which the finial bases 30, and outer finial covers 22 and 122 remain fixed and do not move in relation to the outer and inner rod sections 11 and 12. In contrast, the end pads 40 and swivel bushings 44 are free to rotate on their finial bases 30, and are also free to rotate with respect to the finial covers 22 and 122 and the outer and inner rod sections 11 and 12.

Figure 13:
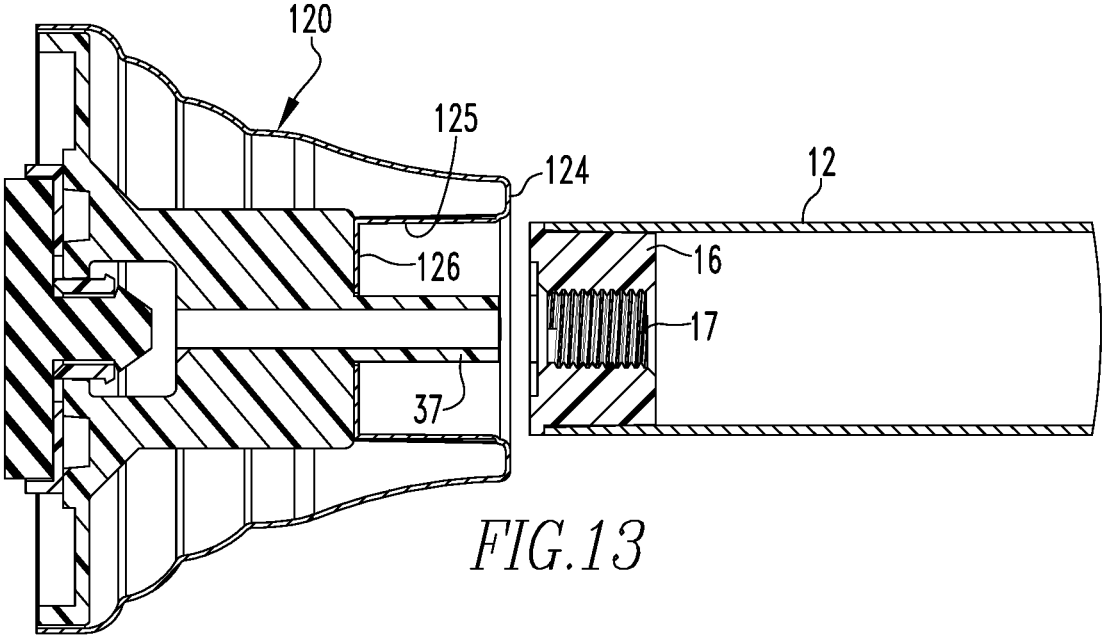
FIGS. 13 and 14 are side sectional views illustrating installation of a finial assembly on the end of a curtain rod in accordance with an embodiment of the present invention.
Figure 14:
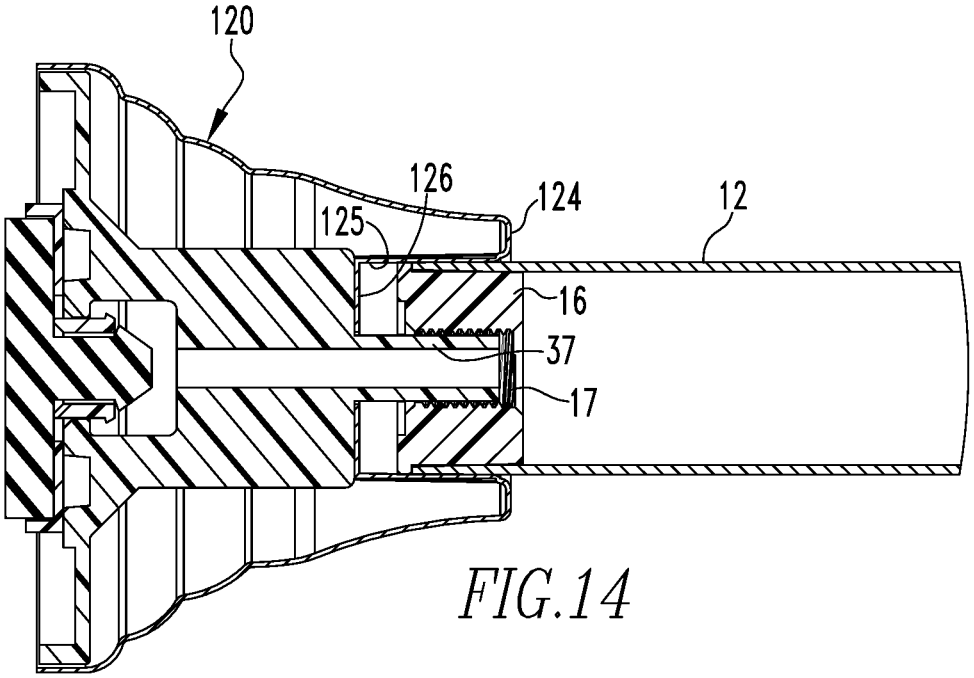

FIGS. 13 and 14 illustrate assembly steps for securing the finial assembly 120 onto the end of the inner rod section 12 in accordance with an embodiment of the present invention. Such assembly may occur at the factory prior to use by a customer. In FIG. 13, the finial assembly 120 is detached from the end of the inner rod section 12. In FIG. 14, the threaded stud 37 of the finial base 30 is partially threaded into the threaded hole 17 of the threaded insert 16. Continued threading of the threaded stud 37 into the threaded hole 17 results in the fully assembled configuration shown in FIG. 3, wherein the inner rod section 12, finial cover 122 and final base 30 are held securely together, while the rotatable end pad 40 and swivel bushing 44 are free to rotate in relation thereto.

To install the telescoping curtain rod 10, the outer and inner telescoping rod sections 11 and 12 can be moved with respect to each other until the ends of the finial assemblies 20 and 120 are adjacent to two opposing support surfaces, with their rotatable end pads 40 contacting the support surfaces. The outer and inner rod sections 11 and 12 can then be rotated with respect to each other to engage a locking mechanism, thereby preventing movement of the outer and inner rod sections 11 and 12 with respect to each other in the axial direction. Because the end pads 40 can rotate with respect to the remainder of their finial assemblies 20 and 120, once the end pads 40 engage the support surfaces, they remain stationary with respect to the support surface, even as the outer and inner rod sections 11 and 12 are rotated. This prevents walking of the rotatable end pads 40 as the telescoping curtain rod 10 is tightened between the support surfaces. Thus, during installation, the telescoping inner rod section 12 may be extended from the outer rod section 11 to a desired axial position in which the rotatable end pads 40 and stationary finial covers 22 and 122 are in initial contact positions against the window walls, or the bath or shower stall walls.

As used herein, "including," "containing" and like terms are understood in the context of this application to be synonymous with "comprising" and are therefore open-ended and do not exclude the presence of additional undescribed or unrecited elements, materials, phases or method steps. As used herein, "consisting of" is understood in the context of this application to exclude the presence of any unspecified element, material, phase or method step. As used herein, "consisting essentially of" is understood in the context of this application to include the specified elements, materials, phases, or method steps, where applicable, and to also include any unspecified elements, materials, phases, or method steps that do not materially affect the basic or novel characteristics of the invention.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application and the appended claims, the articles "a," "an," and "the" include plural referents unless expressly and unequivocally limited to one referent.

Whereas particular embodiments of this invention have been described above for purposes of illustration, it will be evident to those skilled in the art that numerous variations of the details of the present invention may be made without departing from the invention as defined in the appended claims.

What is claimed is:

1. A curtain rod and finial assembly comprising:

a telescoping curtain rod having a first end and a second end; and a first finial assembly mourned on the first end of the curtain rod comprising:

a finial base including a body, an annular base rim, a central through hole radially inside the annular base rim, a shoulder at an end of the body opposite from the annular base rim, and a threaded stud extending from the shoulder;

a finial cover surrounding the finial base and including a recess receiving the first end of the curtain rod; and a rotatable end pad rotatably mounted adjacent the annular base rim and including a projection extending through the through hole of the finial base structured and arranged to retain the rotatable end pad on the final base, wherein the threaded stud of the finial base is threadingly secured to the first end of the curtain rod, a bottom wall of the recess of the finial cover is located between the shoulder of the finial base and the first end of the curtain rod, and the rotatable end pad is fixedly mounted on a swivel bushing comprising an annular outer rim located radially outside the rotatable end pad and an annular retaining collar surrounding the projection of the rotatable end pad and extending through the central through hole of the finial base.

2. The curtain rod finial assembly of claim 1, wherein the first end of the curtain rod, the finial base, and the finial cover are fixed together and do not rotate with respect to each other during installation of the curtain rod and finial assembly on a support structure, and the rotatable end pad is freely rotatable with respect to the curtain rod, the finial base, and the finial cover.

3. The curtain rod finial assembly of claim 1, wherein the body of the finial base includes two opposing broad side surfaces extending from the annular base rim to the shoulder, and two opposing narrow side surfaces extending from the annular base rim to the shoulder and connected to the two opposing broad side surfaces, wherein the opposing broad side surfaces are larger than the opposing narrow side surfaces.

4. The curtain rod finial assembly of claim 3, wherein the body of the finial base has a width measured between the two opposing narrow side surfaces and a thickness measured between the two opposing broad side surfaces, and the width is at least 2 times greater than the thickness.

5. The curtain rod finial, assembly of claim 4, wherein a ratio of the width to the thickness is from 3:1 to 8:1.

6. The curtain rod finial assembly of claim 1, wherein the shoulder of the finial body extends in a radial extension direction perpendicular to an axial direction of the curtain rod a distance equal to or greater than an inner diameter of the curtain rod.

7. The curtain rod finial assembly of claim 1, further comprising a threaded insert secured inside the first end of the curtain rod having a central threaded hole, and the threaded stud of the finial base is threadingly engaged with the central threaded hole of the threaded insert to thereby prevent relative rotation of the finial body and the finial cover in relation to the first end of the curtain rod during, installation of the curtain rod and finial assembly on a support structure.

8. The curtain rod finial assembly of claim 1, further comprising a second finial assembly mounted on the second end of the curtain rod comprising:

an additional finial base including a body, an annular base rim, a central through hole radially inside the annular base rim, a shoulder at an end of the body opposite from the annular base rim, and a threaded stud extending from the shoulder;

an additional finial cover surrounding the additional finial base and including a recess receiving the second end of the curtain rod; and an additional rotatable end pad rotatably mounted adjacent the annular base rim and including a projection extending through the through hole of the additional finial base structured and arranged to retain the rotatable end pad on the additional finial base, wherein the threaded stud of the additional finial base is threadingly secured to the second end of the curtain rod, a bottom wall of the recess of the additional finial cover is located between the shoulder of the additional finial base and the second end of the curtain rod, and the additional rotatable end pad is fixedly mounted on a swivel bushing comprising an annular outer rim located radially outside the additional rotatable end pad and an annular retaining collar surrounding the projection of the additional rotatable end pad and extending through the central through hole of the additional finial base.

9. The curtain rod finial assembly of claim 8, wherein the second end of the curtain rod, the additional finial base, and the additional finial cover are fixed together and do not rotate with respect to each other during installation of the curtain rod and additional finial assembly on a support structure, and the additional rotatable end pad is freely rotatable with respect to the curtain rod, the additional finial base, and the additional finial cover.

10. The curtain rod finial assembly of claim 8, wherein the body of the additional finial base includes two opposing broad side surfaces extending from the annular base rim to the shoulder, and two opposing narrow side surfaces extending from the annular base rim to the shoulder and connected to the two opposing broad side surfaces, wherein the opposing broad side surfaces are larger than the opposing narrow side surfaces.

11. The curtain rod finial assembly of claim 10, wherein the additional finial body of the additional finial base has a width measured between the two opposing narrow side surfaces and a thickness measured between the two opposing broad side surfaces, and the width is at least 2 times greater than the thickness.

12. The curtain rod finial assembly of claim 11, wherein a ratio of the width to the thickness is from 3:1 to 8:1.

13. The curtain rod finial assembly of claim 8, wherein the shoulder of the additional finial body extends in a radial extension direction perpendicular to an axial direction of the curtain rod a distance equal to or greater than an inner diameter of the curtain rod.

14. The curtain rod finial assembly of claim 8, further comprising a threaded insert secured inside the second end of the curtain rod having a central threaded hole, and the threaded stud of the additional finial base is threadingly engaged with the central threaded hole of the threaded insert to thereby prevent relative rotation of the additional finial body and the additional finial cover in relation to the second end of the curtain rod during installation of the curtain rod and additional finial assembly on a support structure.

15. The curtain rod finial assembly of claim 8, wherein the finial base secured to the first end of the curtain rod and the additional finial base secured to the second end of the curtain rod have the same shape and size.

16. A finial assembly for mounting on an end of a curtain rod comprising:

a finial base including a body, an annular base rim, a central through hole radially inside the annular base rim, a shoulder at an end of the body opposite from the annular base rim, and a threaded stud extending from the shoulder;

a finial cover surrounding the finial base and including a recess structured and arranged to receive the end of the curtain rod; and a rotatable end pad rotatably mounted adjacent the annular base rim and including a projection extending through the through hole of the finial base structured and arranged to retain the rotatable end pad on the finial base, wherein the rotatable end pad is fixedly mounted on a swivel bushing comprising an annular outer rim located radially outside the rotatable end pad and an annular retaining collar surrounding the projection of the rotatable end pad and extending through the central through hole of the finial base.

* * * * *